US008136774B2

(12) United States Patent
Melittas

(10) Patent No.: US 8,136,774 B2
(45) Date of Patent: Mar. 20, 2012

(54) LIGHT BULB HOLDER

(75) Inventor: William S. Melittas, Glen Cove, NY (US)

(73) Assignee: Gem Temp, LLC, Roslyn, NY (US)

( * ) Notice: Subject to any disclaimer, the term of this patent is extended or adjusted under 35 U.S.C. 154(b) by 27 days.

(21) Appl. No.: 12/691,355

(22) Filed: Jan. 21, 2010

(65) Prior Publication Data

US 2010/0265728 A1 Oct. 21, 2010

Related U.S. Application Data

(60) Provisional application No. 61/146,128, filed on Jan. 21, 2009.

(51) Int. Cl.
*E06C 7/14* (2006.01)

(52) U.S. Cl. ..... 248/210; 248/68.1; 248/316.5

(58) Field of Classification Search ..... 248/210, 248/211, 238, 68.1, 74.2, 510, 316.7, 539, 248/316.5, 74.5, 517, 518; 182/129, 230; 206/419, 372, 443; 362/432, 382
See application file for complete search history.

(56) References Cited

U.S. PATENT DOCUMENTS 4,077,595 A * 3/1978 Carter et al. ..... 248/210
4,523,733 A 6/1985 Lunden, Jr.
4,613,042 A * 9/1986 Aeschliman ..... 206/419
4,653,716 A * 3/1987 Sakaguchi ..... 248/316.5
4,714,162 A * 12/1987 Harrison ..... 206/419
4,858,763 A 8/1989 Scott
4,934,635 A * 6/1990 Sherman ..... 248/74.1
5,542,535 A 8/1996 Dalton
5,584,454 A 12/1996 Saunders et al.
5,716,035 A * 2/1998 Nourry et al. ..... 248/316.5
5,934,468 A 8/1999 Scott
5,971,102 A 10/1999 Brown
6,059,245 A * 5/2000 Hermansen et al. ..... 248/311.2
6,502,664 B1 1/2003 Peaker, Sr.
7,878,462 B1 * 2/2011 Larkin ..... 248/55
2005/0056485 A1 3/2005 Tarlow
2007/0145198 A1 * 6/2007 Miller ..... 248/72
2007/0200034 A1 * 8/2007 Urzua ..... 248/68.1
2009/0152047 A1 * 6/2009 McLain ..... 182/129
2010/0012804 A1 * 1/2010 Egan ..... 248/231.81

* cited by examiner

*Primary Examiner* — Ramon Ramirez

(74) *Attorney, Agent, or Firm* — Hoffmann & Baron, LLP

(57) ABSTRACT

A light bulb holder including a gripper unit for holding an elongate tubular light bulb during installation of the bulb in a light fixture. The gripper unit generally includes an attachment member for removably attaching the gripper unit to a ladder and at least one gripper supported on the attachment member. The gripper has opposed resilient fingers defining an opening for receiving a light bulb.

18 Claims, 7 Drawing Sheets

LIGHT BULB HOLDER

CROSS-REFERENCE TO RELATED APPLICATIONS

This application claims the benefit of U.S. Provisional Application No. 61/146,128, filed on Jan. 21, 2009, the specification of which is incorporated by reference herein in its entirety for all purposes.

FIELD OF THE INVENTION

The present invention relates generally to a device for aiding the process of installing light bulbs and, more particularly, to a holder removably attachable to a ladder for holding one or more light bulbs, particularly fluorescent light bulbs.

BACKGROUND OF THE INVENTION

In the process of installing or replacing light bulbs, particularly fluorescent light bulbs, it is typically necessary to employ a stepladder in order to reach the elevated lamp fixture. Moreover, in settings such as in schools and office buildings, it has been a common practice for a custodian or serviceman to additionally carry a large carton or cartons containing incandescent and/or fluorescent light bulbs. Fluorescent light bulbs, in particular, are long, bulky and quite fragile and therefore, must be handled with great care.

One approach in replacing light bulbs involves placing the carton of light bulbs on the ground next to the stepladder and the person changing the lamps making numerous trips up and down the stepladder. Such a process is both tiresome to the person changing the lamps as well as very time consuming Another drawback is the possibility of breakage due to either dropping the light bulb or hitting it against the stepladder during the numerous trips up and down the stepladder.

Thus, in many instances, two servicemen are utilized wherein a first person removes or replaces the light bulb from the fixture while standing on the ladder, and a second person transfers light bulbs to the person standing on the ladder. As can be appreciated, the use of two people to change light bulbs constitutes an inefficient use of labor. Another drawback is the possibility of breaking the light bulbs during handling between the two persons.

It has been known in the art to provide a device for temporarily holding one or more light bulbs whereby a person does not need to make numerous trips up and down a stepladder during the changing operation. For example, U.S. Pat. No. 4,858,763 to Scott discloses a light bulb holster in the form of a flexible bag having pockets to hold a plurality of tubular bulbs. A flap is utilized to cover the tops of the bulbs during transport and to secure the holster to a ladder brace at the work site.

U.S. Pat. No. 4,714,162 to Harrison shows a fluorescent light bulb holder including an upper and a lower bracket which are attachable to a ladder. The upper and lower brackets define pockets for loosely respectively retaining upper and lower portions of one or more fluorescent light bulbs.

U.S. Pat. No. 4,613,042 to Aeschliman discloses a plurality of tapered, rigid tubes of different lengths, integrally jointed together, such that a plurality of lamps can be held by the tubes at selected heights. The tubes may be clamped to one end of a stepladder using a vise-like mechanism.

While each of these devices includes features related to installations of light bulbs, each has its own drawbacks. For example, the flexible nature of the Scott light bulb holster does not afford much protection against breakage of the bulbs stored inside the holster. Breakage is also a concern with the Harrison device since the bulbs are loosely held in the pockets of this device and are not separated from one another. The Aeschliman device offers support for only a small portion of one end of the fluorescent light bulb, thereby exposing a large length of the fluorescent light bulb.

Accordingly, it would be desirable to provide a device for temporarily holding one or more light bulbs that is easily transportable, and which offers maximum protection to the bulbs.

SUMMARY OF THE INVENTION

The present invention is a light bulb holder including a gripper unit for holding an elongate tubular light bulb during installation of the bulb in a light fixture. The gripper unit generally includes an attachment member for removably attaching the gripper unit to a ladder and at least one gripper supported on the attachment member. The gripper has opposed resilient fingers defining an opening for receiving a light bulb.

The resilient fingers may be made from a pliable shape-retaining material and formed integral with the attachment member. Alternatively, the gripper has two fingers hinged together about a common pivot point.

In a preferred embodiment, the gripper unit has a first arcuate shaped finger and a second arcuate shaped finger hingedly connected to each other about a common pivot point, wherein the first and second fingers face inward toward each other to form a claw-shaped gripper. A biasing element is provided to bias the first and second fingers toward each other and an attachment member is provided which supports the gripper for removable attachment to a ladder.

Preferably, the biasing element is a torsion spring and the gripper further includes a depressible button for urging the hinged fingers apart. In this regard, the button can include a cam structure cooperating with structure provided on the hinged fingers for urging the fingers apart.

The gripper attachment member is preferably in the form of a bracket having a support face for supporting the gripper and two arms extending opposite the support face. The arms define a channel therebetween for attachment to the ladder and at least one arm preferably includes a hook extending inward into the channel from an end of the arm.

The light bulb holder of the present invention further preferably includes a pocket unit for removable attachment to the ladder a distance below the gripper unit. The pocket unit includes a pocket element defining a pocket for receiving the end of a light bulb and an attachment member in the form of a bracket having a support face for supporting the pocket element and two arms extending opposite the support face. The arms define a channel therebetween for attachment to the ladder.

The preferred embodiments of the light bulb holder of the present invention, as well as other objects, features and advantages of this invention, will be apparent from the following detailed description, which is to be read in conjunction with the accompanying drawings.

DETAILED DESCRIPTION OF THE PREFERRED EMBODIMENTS

Figure 1:
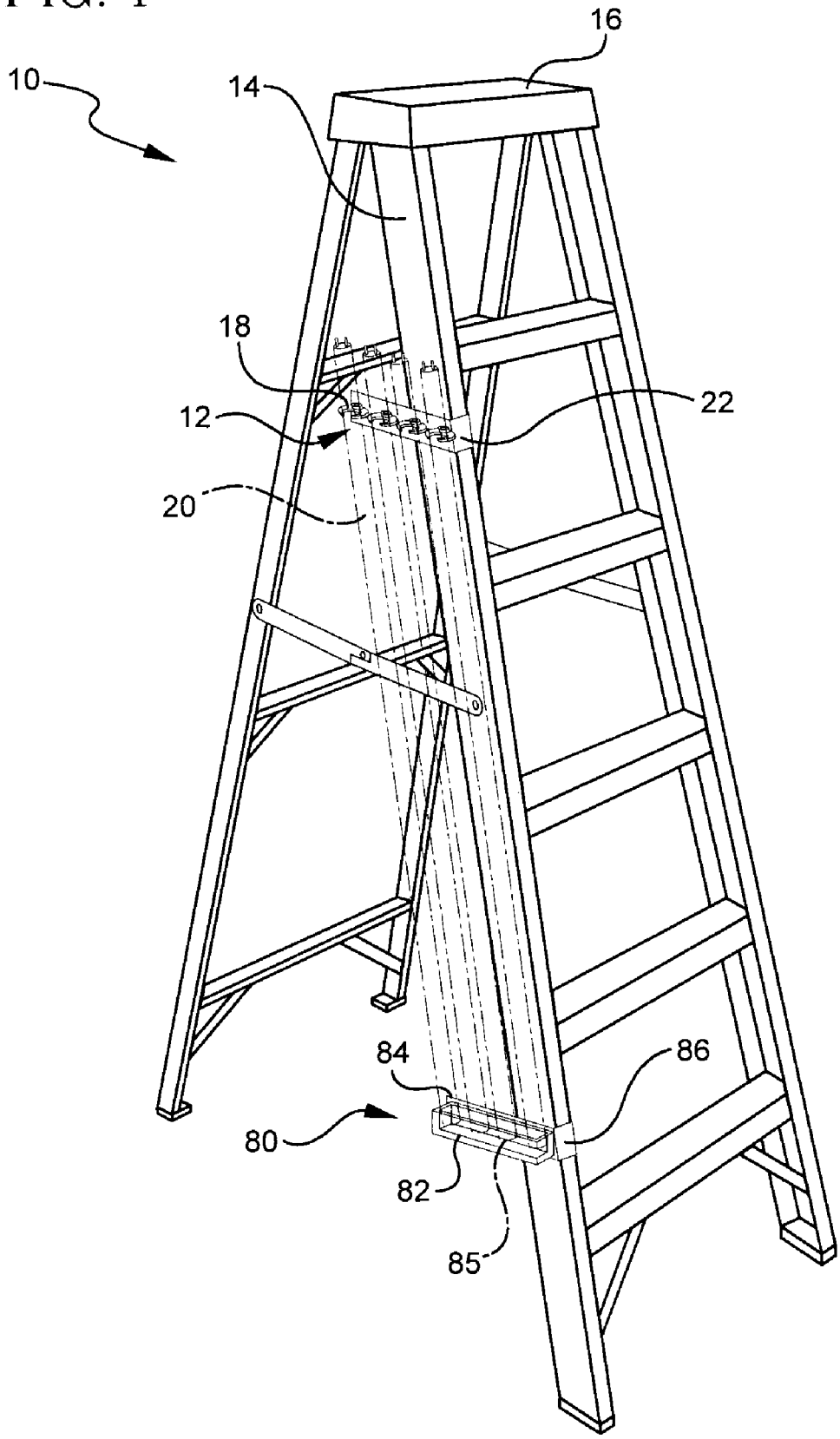
FIG. 1 is a top perspective view of the fluorescent light bulb holder of the present invention attached to a stepladder.
Figure 2:
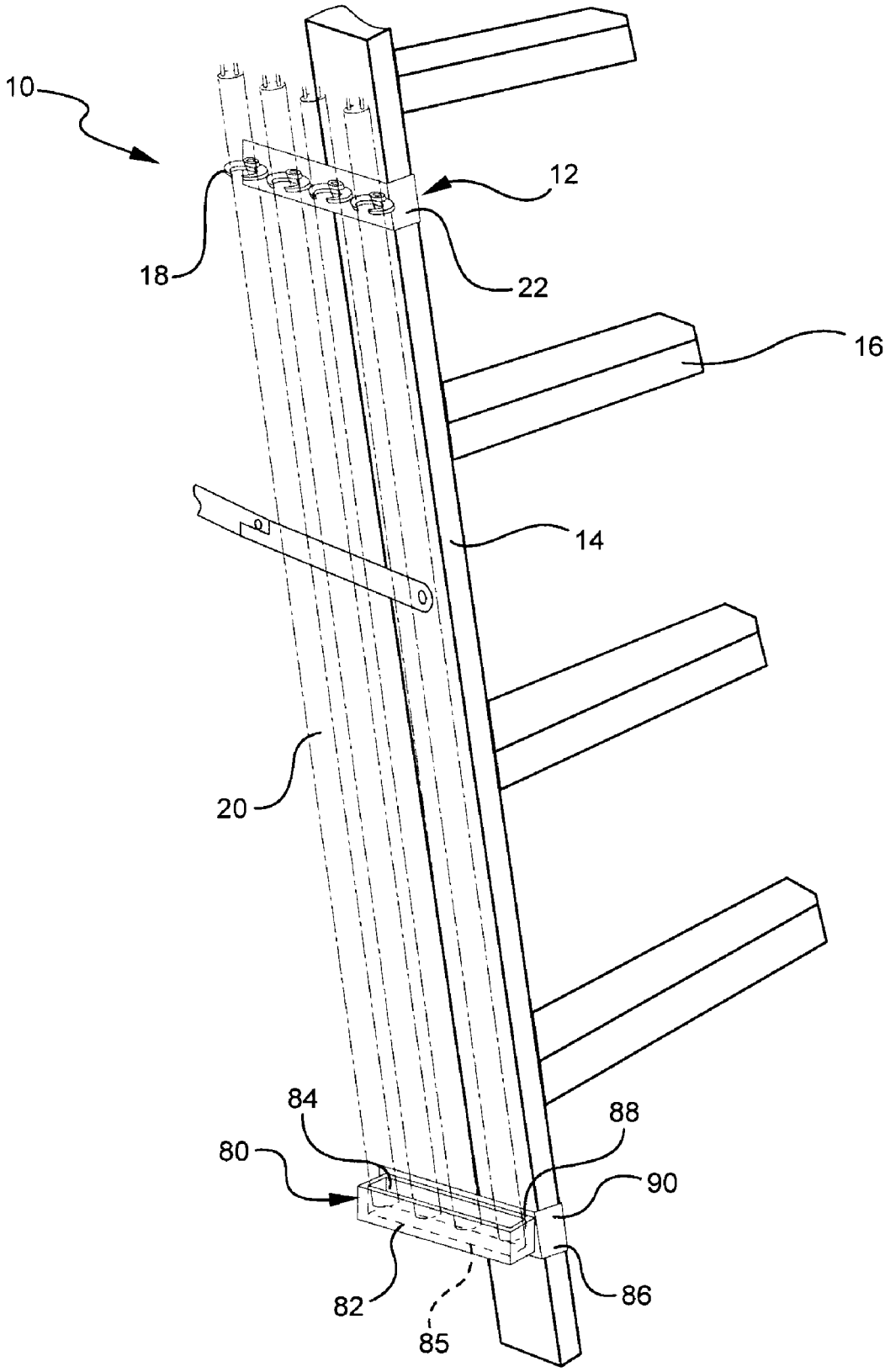
FIG. 2 is an enlarged perspective view of the light bulb holder shown in FIG. 1.

Referring first to FIGS. 1 and 2, a light bulb holder 10 formed in accordance with the present invention is shown. While the present invention is particularly well suited for long tubular fluorescent light bulbs, it can be appreciated by those skilled in the art that the holder of the present invention can also be used with incandescent bulbs and/or compact fluorescent bulbs (CFLs).

The holder 10 generally includes at least one gripper unit 12 removably attachable to a side rail 14 of a stepladder 16. The gripper unit 12 includes at least one gripper 18 for gripping a fluorescent light bulb 20 and an attachment member 22 for removably attaching the gripper unit to the ladder 16.

Figure 3:
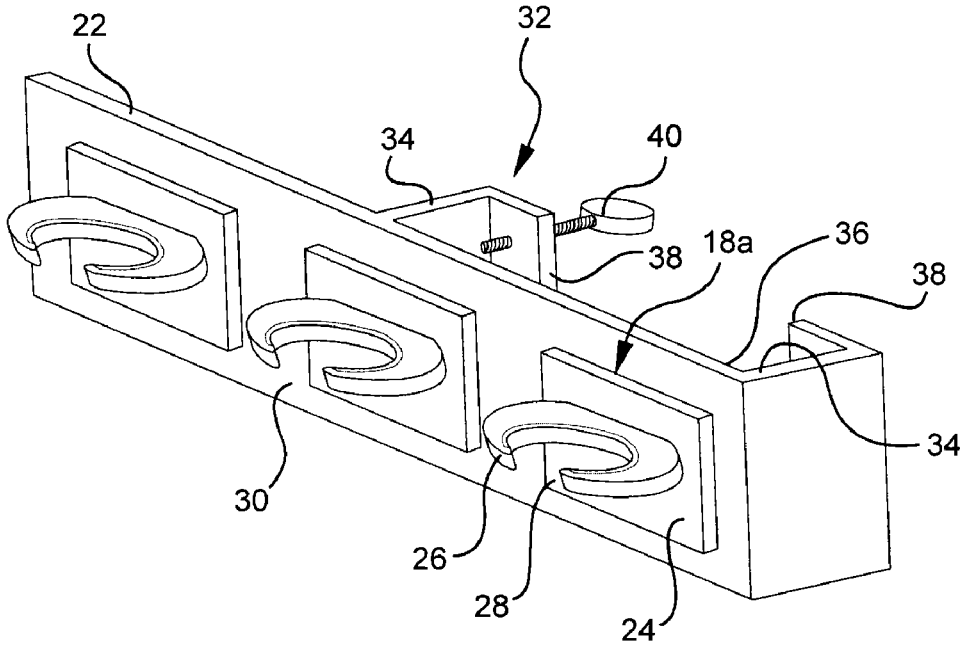
FIG. 3 is an enlarged perspective view of a first embodiment of the gripper unit of the light bulb holder of the present invention.

Referring additionally to FIG. 3, in its simplest form, the gripper 18*a* may take the form of a unitary resilient element 24 having two opposed arcuate fingers 26 defining a circular opening 28 for receiving the light bulb 20. The resilient element 24 may be made from a pliable plastic or rubber which will deform yet tend to retain its shape so as to provide resiliency to the element 24. The resilient element 24 can be attached to the attachment member 22 in a conventional manner, such as by fastener or adhesive, or it may be molded integral with the attachment member.

The attachment member 22 is preferably in the form of a bracket having a gripper support face 30 for supporting at least one and preferably a plurality of grippers 18 thereon. Extending in the opposite direction of the support face 30 is a clamping member 32 sized and shaped to fit snugly around the side rail 14 of the stepladder 16. In this regard, the clamping member 32 preferably includes two arms 34 extending away from the support face 30 and defining a channel 36 therebetween and a hook 38 disposed at the end of each arm and extending inward into the channel. The clamping member 32 and the support face 30 are preferably integrally molded or extruded together from a durable yet resilient material such as plastic or hard rubber. However, it is conceivable to form the clamping member 32 and the support face 30 separately and assemble the two in a conventional manner to form the attachment member 22.

In use, the attachment member 22 can be positioned at a convenient location on the ladder 16 and the arms 34 of the clamping member 32 can be deflected outward so as to permit the side rail 14 of the ladder to be received in the channel 36 defined by the arms. Once wrapped around the side rail 14, the arms 34 can be released whereby the resilient material of the clamping member 32 will cause the arms to return to their original position to clasp the side rail. To further facilitate clasping of the side rail 14, the arms 34 and/or the hooks 38 can be bent at an angle less than ninety degrees so that the clamping member 32 will remain deflected when placed on the side rail and thereby maintain a better gripping force.

It is further contemplated that various other clamping devices can be utilized with the attachment member 22 in addition to or in place of the clamping member 32 described above. For example, the attachment member 22 may include a threaded thumb screw 40, or other fastener, for securing the attachment member to the ladder.

Similarly, the attachment member 22 may employ straps, as shown and described later in FIG. 10, or other tie-down methods to fasten the attachment member to the ladder. Accordingly, the invention is not limited to the clamping member 32 described above.

Once the attachment member 22 is secured to the side rail 14 of the ladder 16, a fluorescent light bulb 20 can be loaded in the gripper 18. This can be accomplished by separating the opposed arcuate fingers 26 of the resilient element 24 and placing the bulb 20 in the circular opening 30 defined by the fingers. The fingers 26 are then released whereby the resiliency of the resilient element 24 causes the fingers to return to their original position thereby wrapping around the circular periphery of the light bulb 20. The light bulb 20 is thus safely and securely held by the gripper 18.

Figure 4:
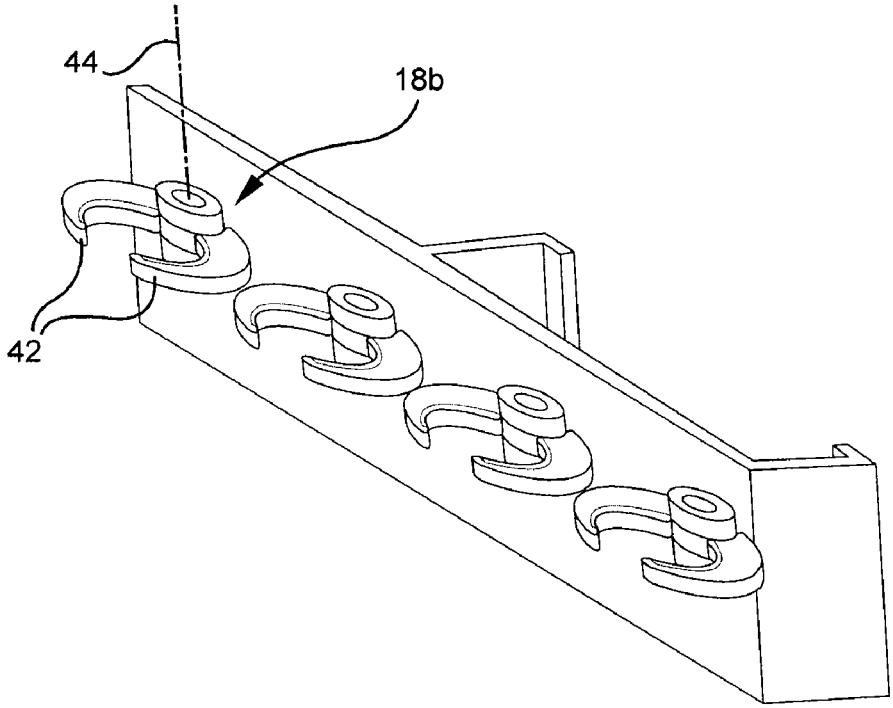
FIG. 4 is an enlarged perspective view of a preferred embodiment of the gripper unit.
Figure 5:
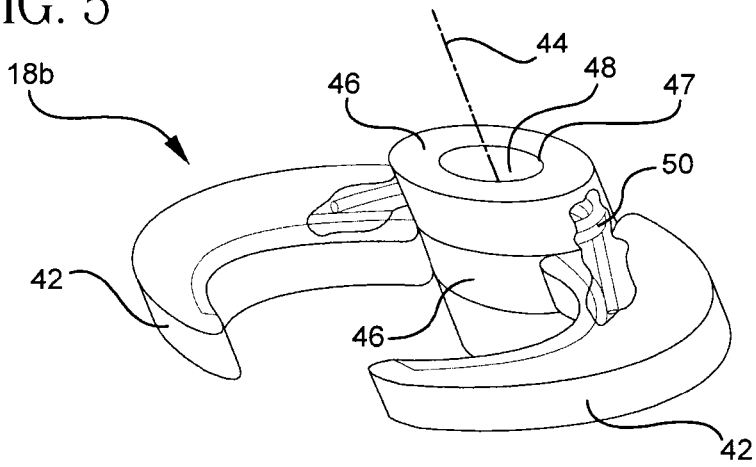
FIG. 5 is an enlarged isolated perspective view of one of the grippers of the gripper unit shown in FIG. 4.
Figure 6:
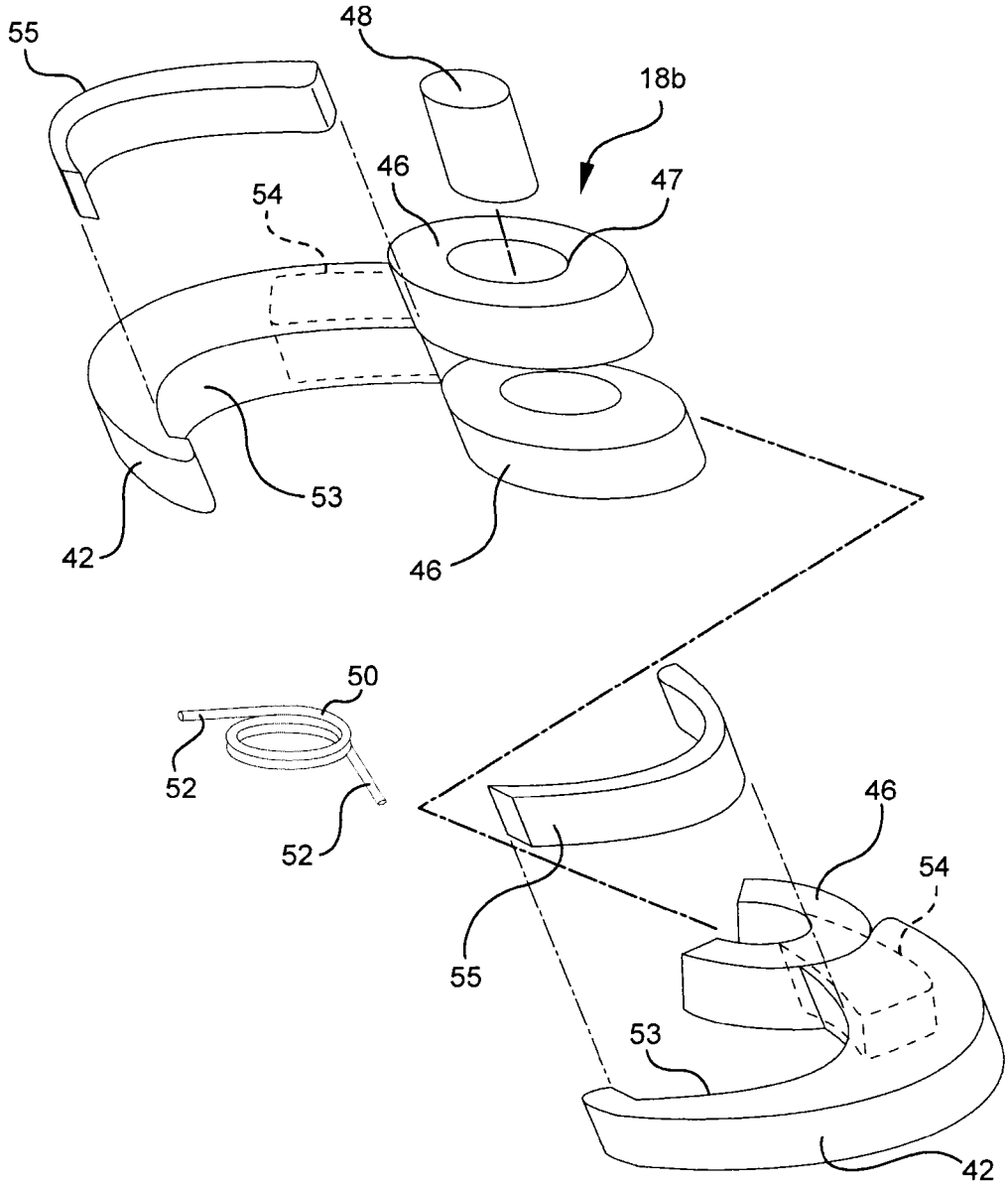
FIG. 6 is an exploded perspective view of one of the grippers of the gripper unit shown in FIG. 4.

Turning now to FIGS. 4-6, in a preferred embodiment, the gripper 18*b* takes the form of two separate arcuate fingers 42, which are hinged together about a common pivot axis 44. In this regard, each finger 42 includes at least one annular shoulder portion 46 defining an opening 47 to receive a pin 48. The shoulder portion 46 of one finger 42 is interlaced with a shoulder portion of an opposing finger whereby the openings 47 in the respective shoulder portions are aligned to receive the pin 48. The openings 47 and the pin 48 are sized to permit pivotal movement of the opposed fingers 42 about the pivot axis 44.

Each gripper 18*b* further preferably includes a biasing element 50 to bias the opposed fingers toward each other. The biasing element 50 is preferably in the form of a torsion spring having opposed arms 52 received within interior cavities 54 of the respective fingers 42 and an inner diameter sized to encircle the pin 48. The torsion spring 50 acts to resist outward deflection of the fingers 42 with respect to each other and biases the fingers inwardly toward each other so that the fingers are maintained in a normally closed position. The angle of the opposed arms 52 further prevents the fingers 42 from closing entirely.

Also, preferably secured to the inner face 52 of each finger 42 is a cushion element 54. The cushion element 55 is preferably a soft resilient pad material secured to the inner surface 52 of the finger 42 with an adhesive. The cushion element 55 thus prevents damage to a light bulb 20 gripped between the fingers 42 of the gripper 18*b*.

Figure 7:
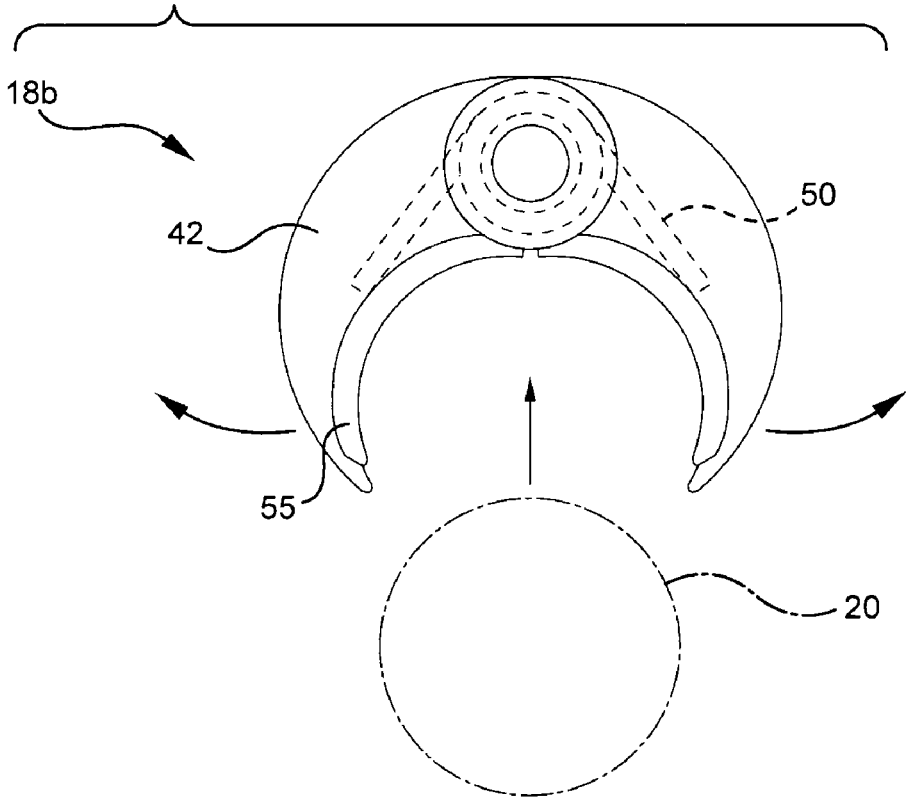
FIG. 7 is a top plan view of one of the grippers of the gripper unit receiving a fluorescent light bulb.
Figure 8:
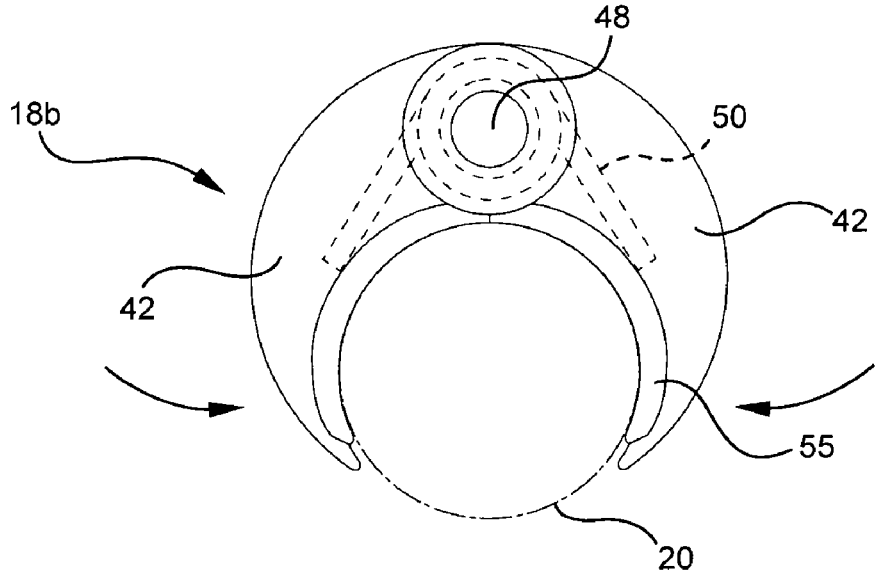
FIG. 8 is a top plan view of one of the grippers of the gripper unit holding a fluorescent light bulb.

Use of the preferred embodiment of the gripper 18*b* shown in FIGS. 4-6 is similar to that described above. In particular, as shown in FIGS. 7 and 8, to load a light bulb 20 into the gripper 18*b*, the opposed arcuate fingers 42 are separated against the force of the biasing element 50 and the bulb 20 is placed in the circular opening defined by the fingers. The fingers 42 are then released whereby the biasing element 50 returns the fingers to their original position thereby wrapping around the circular periphery of the light bulb 20. The cushioning elements 55 of the fingers 42 ensure that the light bulb 20 is safely held by the gripper 18*b* without risk of damage. To remove the light bulb 20, the bulb may simply be pulled radially outwardly from the gripper 18*b* whereby the fingers 42 are gently urged apart to release the bulb.

Figure 9:
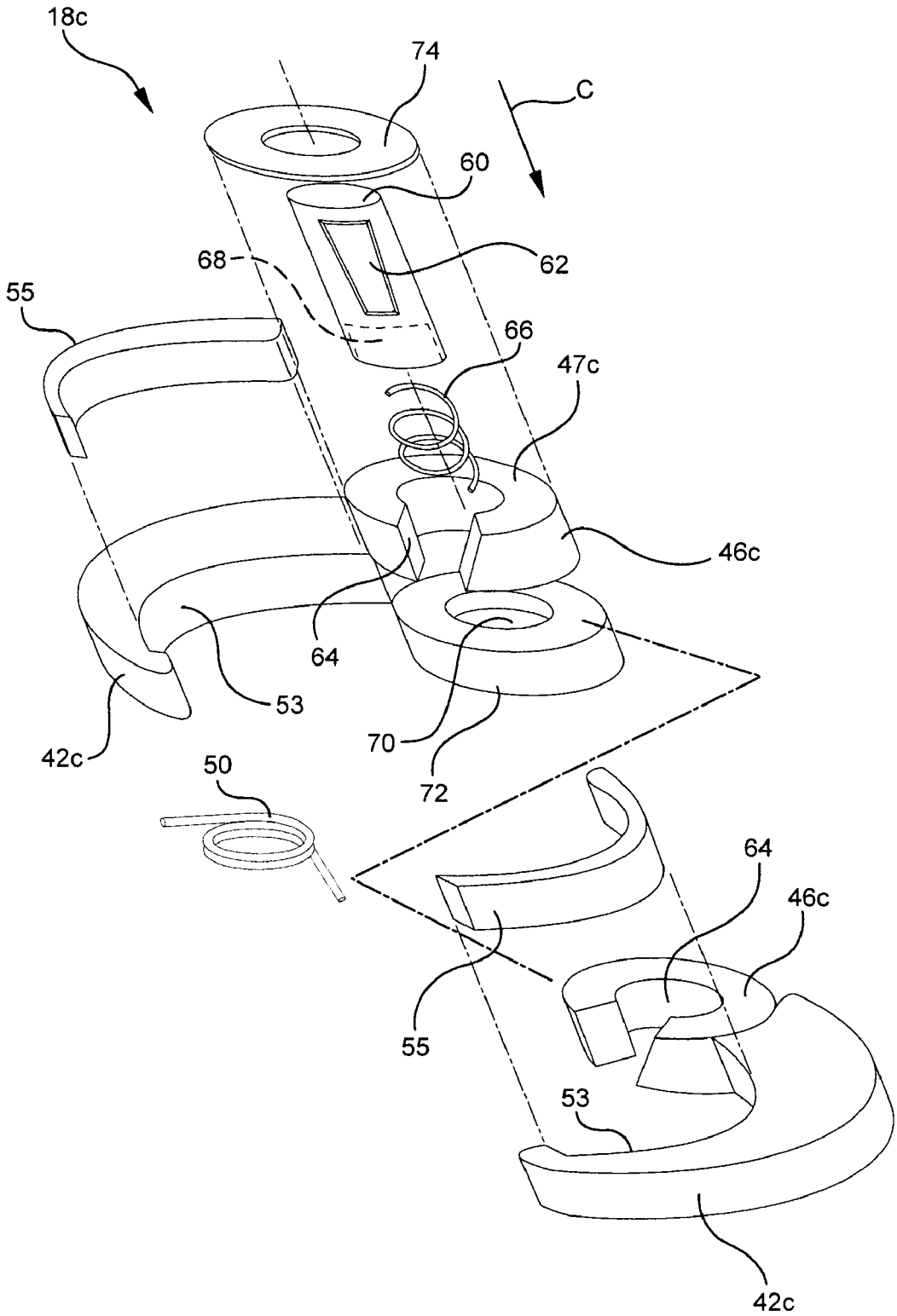
FIG. 9 an exploded perspective view of another alternative embodiment of one of the grippers of the gripper unit shown in FIG. 4.

In another alternative embodiment, as shown in FIG. 9, the pin 48 can be replaced by a button 60 which can be depressed to urge the fingers 42*c* apart for loading a light bulb 20 into the gripper 18*c*. For example, the button may include a cam structure 62 or wedge formed on its outer peripheral surface which engages cooperating inclined ramp surfaces 64 formed around the opening 47*c* on the shoulder portions 46*c* of the fingers 42*c*. This wedge and ramp structure results in the fingers 42*c* being urged apart from each other as the button 60 is pushed downward in the direction of arrow C shown in FIG. 9.

Preferably, a biasing element 66, such as a compression spring, is provided to bias the button 66 upward, returning the button to its normal position, wherein the fingers 42*c* are returned to their closed position by virtue of the torsion spring 50 contained therein. The biasing element 66 may be disposed within a recess 68 formed in the bottom of the button 60 and be biased against a floor 70 provided in a bottom shoulder portion 72 of one of the fingers 42*c*. Moreover, a retaining plate 74 may also be provided to retain the button 60 within the opening 47*c* of the finger shoulder portions 46*c* and 72.

Operation of the gripper 18*c* shown in FIG. 9 is basically the same as that described above, with the exception that the button 60 is utilized to urge the fingers 42*c* of the gripper 18*c* apart to load a light bulb 20 into the gripper. To release a light bulb 20 from the gripper 18*c*, the button 60 may again be depressed, wherein the cam structure 62 provided on the button is driven downward in the direction C shown in FIG. 9. This downward movement of the cam structure 62 forces the wider part of the cam structure between the inclined ramp surfaces 64 of the finger shoulder portions 46*c*, thereby moving the opposed inclined ramp surfaces apart so that the fingers 42*c* of the gripper 18*c* open.

Returning to FIGS. 1 and 2, the light bulb holder 10 of the present invention further preferably includes a pocket unit 80 removably attachable to the side rail 14 of the stepladder 16 at a position below the gripper unit 12. The pocket unit 80 generally includes a pocket element 82 defining a pocket 84 for receiving the ends of the fluorescent light bulbs 20 and an attachment element 86 for removably attaching the pocket unit to the ladder 16. The pocket element 82 can be attached to the attachment member 86 in a conventional manner, such as by fastener or adhesive, or it may be molded integral with the attachment member.

The pocket element 82 may simply consist of a peripheral wall surrounding an interior pocket 84, as shown in FIGS. 1 and 2. It is also conceivable for the pocket element 82 to be in the form of a block having a plurality of pockets or recesses formed therein for individually receiving the respective ends of fluorescent light bulbs 20. In any event, at the bottom of the pocket 84 (or at the bottom of each individual pocket), a cushion 85 of foam material is preferably provided to protect the terminals extending from the ends of the fluorescent light bulbs 20 when the bulbs are received in the pocket.

The pocket unit attachment member 86 is preferably in the form of a bracket similar to the gripper unit attachment member 22 described above. In particular, the pocket unit attachment member 86 includes a support face 88 sized to accommodate a pocket element 82 having a pocket 84 with a length corresponding to the number of grippers 18 provided on the gripper unit 12. Extending in the opposite direction of the support face 88 is a clamping member 90 sized and shaped to fit snugly around the side rail 14 of the stepladder 16.

As described above with respect to the gripper unit attachment member 22, the clamping member 90 may include two arms extending away from the support face 88 and defining a channel therebetween and a hook disposed at the end of each arm and extending inward into the channel. Again, various other clamping devices can be utilized with the attachment member 86 in addition to or in place of the clamping member 90 described. Accordingly, the invention is not limited to the clamping member 90 described herein.

The clamping member 90 and the support face 88 are preferably integrally molded or extruded together from a durable yet resilient material such as plastic or hard rubber. However, it is conceivable to form the clamping member 90 and the support face 88 separately and assemble the two in a conventional manner to form the pocket unit attachment member 86.

In use, the attachment member 86 can be positioned at a convenient location on the ladder 16 a suitable distance below the gripper unit 12. Upon loading a fluorescent light bulb 20 into a gripper 18 of the gripper unit 12, as described above, the free end of the light bulb can be slipped into the pocket 84 of the pocket unit 80 to provide additional support for the light bulb. Upon release of the light bulb 20 from the gripper unit 12, the bulb is simply lifted out of the pocket 84 of the pocket unit 80.

Figure 10:
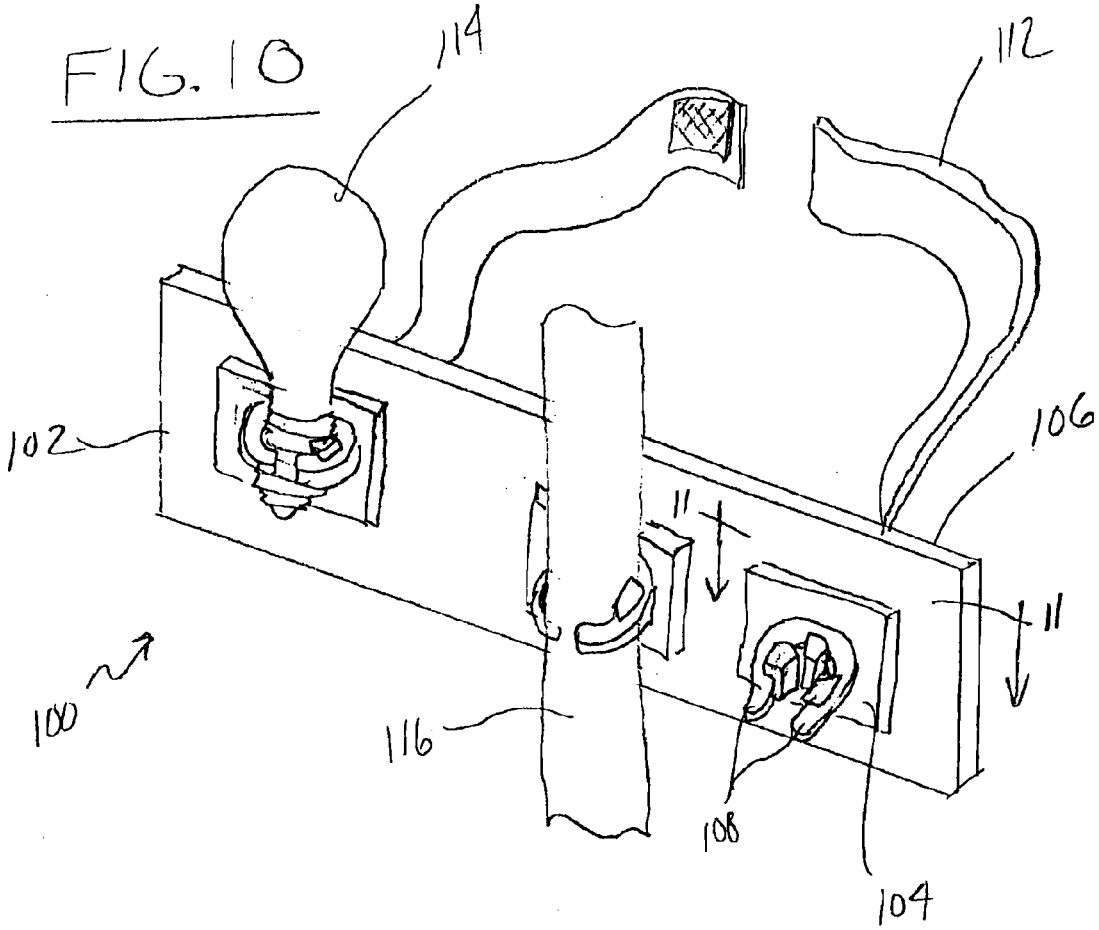
FIG. 10 is an enlarged perspective view of still another embodiment of the gripper unit of the light bulb holder of the present invention.
Figure 11:
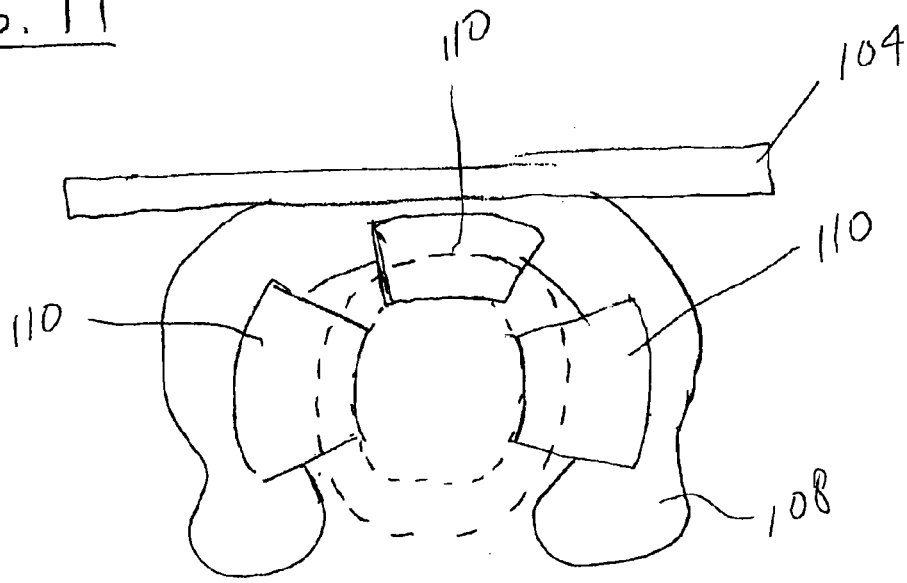
FIG. 11 is a top plan view of one of the grippers shown in FIG. 10 taken along the line 11-11.

In still another alternative embodiment, as shown in FIGS. 10 and 11, the holder 100 includes a gripper unit 102 having at least one unitary gripper 104 for gripping a light bulb and an attachment member 106 for removably attaching the gripper unit to the ladder. In this embodiment, however, the gripper 104 takes the form of a unitary resilient element having two opposed arcuate fingers 108 defining a circular opening for receiving the light bulb. Again, the gripper 104 may be made from a pliable plastic or rubber which will deform yet tend to retain its shape so as to provide resiliency to the element.

Disposed on the inner surface of the fingers 108 is an arrangement of cushion element 110 made of a soft resilient pad material, such as foam rubber. Preferably, there are three cushion elements molded, or otherwise secured, within recesses of the fingers in a semi-circular arrangement. The cushion elements 110 further preferably include arcuate inner contact surfaces that generally match the curvature of the bulb to be retained therein.

The cushion elements 110 are sufficiently compressible to accommodate light bulbs of various sizes (e.g., T8, T11, A19). Specifically, as represented by dashed lines in FIG. 11, light bulbs of different diameter can be safely secured in the gripper 104 without damage to the light bulb.

As also shown in FIG. 10, a Velcro® strap 112 can also be utilized to secure the holder 102 to a ladder, as described above, the holder can be used to hold incandescent bulbs 114, as well as fluorescent bulbs 116.

As a result of the present invention, a simple device is provided for safely and securely holding incandescent and/or fluorescent light bulbs during bulb installation or replacement in light fixtures. The device is easily attachable to a stepladder and is therefore conveniently transportable from one light fixture to another.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A light bulb holder comprising a gripper unit including:

an attachment member for removably attaching said gripper unit to a ladder; and at least one gripper supported on said attachment member, said gripper having opposed resilient fingers defining an opening for receiving a light bulb, wherein said attachment member is in the form of a bracket having a support face for supporting said gripper and two arms extending opposite said support face, said arms defining a channel therebetween for attachment to the ladder, and wherein at least one arm includes a hook extending inward into said channel from an end of said arm.

2. A light bulb holder as defined in claim 1, wherein said resilient fingers are made from a pliable shape-retaining material.

3. A light bulb holder comprising a gripper unit including:

an attachment member for removably attaching said gripper unit to a ladder; and at least one gripper supported on said attachment member, said gripper having opposed resilient fingers defining an opening for receiving a light bulb, wherein said gripper has two fingers hinged together about a common pivot point, and wherein said gripper further includes a biasing element for biasing said hinged fingers toward each other, and wherein said gripper further includes a depressible button for urging said hinged fingers apart, and wherein said button includes a cam structure cooperating with structure provided on said hinged fingers for urging said fingers apart.

4. A light bulb holder as defined in claim 3, wherein said attachment member is in the form of a bracket having a support face for supporting said gripper and two arms extending opposite said support face, said arms defining a channel therebetween for attachment to the ladder.

5. A light bulb holder as defined in claim 4, wherein at least one arm includes a hook extending inward into said channel from an end of said arm.

6. A light bulb holder as defined in claim 1, wherein said resilient fingers of said gripper are arcuate shaped.

7. A light bulb holder as defined in claim 1, wherein said gripper has two fingers hinged together about a common pivot point.

8. A light bulb holder as defined in claim 7, wherein said gripper further includes a biasing element for biasing said hinged fingers toward each other.

9. A light bulb holder as defined in claim 8, wherein said biasing element is a torsion spring.

10. A light bulb holder as defined in claim 8, wherein said gripper further includes a depressible button for urging said hinged fingers apart.

11. A light bulb holder as defined in claim 1, further comprising a pocket unit for removable attachment to the ladder a distance below said gripper unit, said pocket unit defining a pocket for receiving the end of a light bulb.

12. A light bulb holder as defined in claim 11, wherein said pocket unit includes a pocket element defining said pocket and an attachment member in the form of a bracket having a support face for supporting said pocket element and two arms extending opposite said support face, said arms defining a channel therebetween for attachment to the ladder.

13. A light bulb holder as defined in claim 2, wherein said resilient fingers are formed integral with said attachment member.

14. A gripper unit for holding an elongate tubular light bulb comprising:

a first arcuate shaped finger;

a second arcuate shaped finger connected to said first finger about a pivot point, said first and second fingers facing inward toward each other to form a claw-shaped gripper;

a biasing element for biasing said first and second fingers toward each other;

an attachment member supporting said gripper for removable attachment to a ladder; and a pocket unit for removable attachment to the ladder a distance below said gripper attachment member, said pocket unit defining a pocket for receiving the end of a light bulb.

15. A gripper unit as defined in claim 14, wherein said attachment member is in the form of a bracket having a support face for supporting said gripper and two arms extending opposite said support face, said arms defining a channel therebetween for attachment to the ladder.

16. A gripper unit as defined in claim 14, wherein said biasing element is a torsion spring.

17. A gripper unit as defined in claim 14, further comprising a depressible button for urging said fingers apart.

18. A gripper unit as defined in claim 14, wherein said pocket unit includes a pocket element defining said pocket and an attachment member in the form of a bracket having a support face for supporting said pocket element and two arms extending opposite said support face, said arms defining a channel therebetween for attachment to the ladder.

* * * * *